US010060650B2

(12) United States Patent
Gaspard

(10) Patent No.: US 10,060,650 B2
(45) Date of Patent: Aug. 28, 2018

(54) METHOD FOR MANAGING THE HEATING OF WATER IN A TANK OF A WATER HEATER

(71) Applicant: WINSLIM, Luxembourg (LU)

(72) Inventor: Jean-Yves Gaspard, Gleize (FR)

(73) Assignee: WINSLIM, Luxembourg (LU)

( * ) Notice: Subject to any disclaimer, the term of this patent is extended or adjusted under 35 U.S.C. 154(b) by 263 days.

(21) Appl. No.: 14/910,959

(22) PCT Filed: Jul. 31, 2014

(86) PCT No.: PCT/EP2014/066492
§ 371 (c)(1),
(2) Date: Feb. 8, 2016

(87) PCT Pub. No.: WO2015/018733
PCT Pub. Date: Feb. 12, 2015

(65) Prior Publication Data

US 2016/0187027 A1 Jun. 30, 2016

(30) Foreign Application Priority Data

Aug. 9, 2013 (FR) ..... 13 57935

(51) Int. Cl.
*F24H 1/18* (2006.01)
*F24H 9/20* (2006.01)
*F24H 1/20* (2006.01)

(52) U.S. Cl.
CPC ..... *F24H 9/2021* (2013.01); *F24H 1/185* (2013.01); *F24H 1/201* (2013.01); *F24H 2250/08* (2013.01)

(58) Field of Classification Search
CPC ..... F24H 9/2021; F24H 1/185; F24H 1/201; F24H 2250/08; F24H 9/0214; H05B 1/0244; H05B 1/02; H05B 3/82
(Continued)

(56) References Cited

U.S. PATENT DOCUMENTS 2,513,779 A 7/1950 Bailey
3,936,625 A 2/1976 Burnett
(Continued)

FOREIGN PATENT DOCUMENTS

CN 201039508 3/2008
DE 2650791 A1 5/1978
(Continued)

OTHER PUBLICATIONS

International Search Report with English language translation, dated Sep. 20, 2013, for International Application No. PCT/EP2013/066428, Applicant, WINSLIM, (5 pages).
(Continued)

*Primary Examiner* — Mark Paschall
(74) *Attorney, Agent, or Firm* — Wenderoth, Lind & Ponack, L.L.P.

(57) ABSTRACT

The invention relates to a method for managing the heating of water in a tank of a water heater which comprises a device for electrically heating the water in the tank, characterized in that it comprises, when a water heating phase is actuated: activation of heating by the heating device, determination of a variation of the temperature in the tank over time and determination of at least one water filling state in the tank according to the variation over time.

21 Claims, 5 Drawing Sheets

(58) Field of Classification Search
USPC ..... 392/447; 219/481, 494, 497, 482
See application file for complete search history.

(56) References Cited

U.S. PATENT DOCUMENTS

| | | | | |
|---|---|---|---|---|
| 5,222,185 | A | 6/1993 | McCord, Jr. | |
| 5,334,819 | A | 8/1994 | Lin | |
| 5,442,157 | A * | 8/1995 | Jackson | F24H 9/2035 219/483 |
| 6,242,720 | B1 * | 6/2001 | Wilson | F24H 9/2021 219/486 |
| 6,265,699 | B1 | 7/2001 | Scott | |
| 8,406,932 | B2 * | 3/2013 | Hollaway | A61H 33/005 219/437 |
| 2001/0020615 | A1 | 9/2001 | Bradenbaugh | |
| 2002/0153369 | A1 | 10/2002 | Uemura | |
| 2004/0161227 | A1 | 8/2004 | Baxter | |
| 2006/0237052 | A1 * | 10/2006 | Picardat | A47L 15/0047 134/56 D |
| 2007/0278202 | A1 * | 12/2007 | Long | A47J 31/20 219/214 |
| 2008/0317091 | A1 * | 12/2008 | Siddons | A47J 27/21091 374/102 |
| 2009/0120380 | A1 * | 5/2009 | Chian | F24H 9/2021 122/14.1 |
| 2010/0030396 | A1 * | 2/2010 | Patterson | G01K 7/42 700/300 |
| 2010/0209084 | A1 * | 8/2010 | Nelson | F24H 4/04 392/465 |
| 2012/0067870 | A1 | 3/2012 | Lasko | |
| 2013/0020310 | A1 | 1/2013 | Hacham | |
| 2014/0343888 | A1 * | 11/2014 | Bourke | F24D 11/003 702/136 |
| 2016/0146505 | A1 * | 5/2016 | Hill | F24H 9/2021 392/498 |

FOREIGN PATENT DOCUMENTS

| | | | |
|---|---|---|---|
| DE | 102005021238 | | 11/2006 |
| DE | 102009038669 | | 5/2010 |
| EP | 2420755 | A2 | 2/2012 |
| FR | 2942302 | A1 | 8/2010 |
| JP | 2001241769 | | 9/2001 |
| WO | WO 2008/041785 | | 4/2008 |
| WO | WO 2009/050631 | | 2/2009 |
| WO | WO 2009/137895 | | 11/2009 |
| WO | WO 2014/026878 | | 2/2014 |

OTHER PUBLICATIONS

International Written Opinion with English language translation, dated Sep. 20, 2013, for International Application No. PCT/EP2013/066428, Applicant, WINSLIM, (20 pages).

SIPO First Office action, with English-language translation, dated Oct. 28, 2016, for Chinese Patent Application No. 20130043075.1, filed Jul. 15, 2015, Applicant, WINSLIM (15 pages).

English-language summary of SIPO First Office action, dated Oct. 28, 2016, for Chinese Patent Application No. 20130043075.1, filed Jul. 15, 2015, Applicant, WINSLIM (1 page).

International Search Report, with English language translation, for International Application No. PCT/EP2013/066427, Applicant, WINSLIM, dated Sep. 5, 2013 (3 pages).

International Written Opinion for International Application No. PCT/EP2013/066427, Applicant, WINSLIM (5 pages).

French Search Report dated Mar. 14, 2013, for French Application No. 1257790, Applicant, WINSLIM, filed Aug. 13, 2012 (7 pages).

International Search Report, in English-language translation, dated Oct. 16, 2014, for International Application PCT/EP2014/066492, filed Jul. 31, 2014, Applicant, WINSLIM (2 pages).

International Written Opinion dated Oct. 21, 2014,for International Application PCT/EP2014/066492, filed Jul. 31, 2014, Applicant, WINSLIM (10 pages).

International Search Report, in English-language, dated Nov. 5, 2014, for International Application PCT/EP2014/066493, filed Jul. 31, 2014, Applicant, WINSLIM (3 pages).

International Written Opinion dated Nov. 5, 2014,for International Application PCT/EP2014/066493, filed Jul. 31, 2014, Applicant, WINSLIM (5 pages).

* cited by examiner

METHOD FOR MANAGING THE HEATING OF WATER IN A TANK OF A WATER HEATER

FIELD OF THE INVENTION

The present invention relates to water heating appliances also referred to as water heaters. It particularly relates to a method for managing water heating intended to prevent any shortage of water in the water heater.

TECHNOLOGICAL BACKGROUND

Water heaters are devices for heating water for various household or industrial needs. The term water heater denotes a water storage appliance which has at least one tank serving as a hot water storage heating body, also frequently referred to as a boiler. The water is admitted into the storage tank where it is intended to be heated therein. Furthermore, the invention relates to an electric water storage water heater. The capacity of such a tank is more or less great according to the requirements to which storage appliances are assigned, for example by being associated with one or more bathroom sink taps, a shower and/or a bath, etc.

In a known manner, an electric water heater generally has a heating element immersed in the tank serving as a heating body for heating the water contained therein. The water in the tank of a water heater is naturally stratified if it is not mixed: hot water at the top and cold water at the bottom.

The temperature of the water in the heating body is, in a known manner, monitored by a sensor or a probe, said probe being immersed in the tank and positioned preferably in the vicinity of the water heating device. The probe cannot be placed too close to the heating device as, in this case, the probe would detect the temperature of the heating device and not the temperature of the water to be heated. The drawback of this probe, intended to measure the temperature of the water, is that it is not configured to sense effectively or above all rapidly overheating of the heating device; said device being liable to continue heating until the irremediable damage thereof in the event of it being unable to exchange the heat thereof effectively with the water. The problem is particularly evident for water heaters comprising a heating device in the form of a resistor. Indeed, resistors are known to have a particularly small exchange surface area with water, while requiring a significant time to heat the water. As such, it proves to be particularly difficult to detect, finely and reactively, overheating of the heating device. Overheating is very frequently detected too late giving rise to irreversible damage for the water heater and the heating device.

As such, overheating of the heating device is a known major problem, due to a lack of heating body heat exchange, to a lack of irrigation or to excessive scaling.

The present invention makes it possible to solve all or, at least, some of the drawbacks of current techniques. A problem underlying the present invention is that of proposing a method for managing heating preventing overheating of the heating device by detecting a probable shortage of water in the tank of the water heater.

SUMMARY OF THE INVENTION

To achieve this aim, the invention envisages a method for managing the heating of water in a tank of a water heater which comprises a device for electrically heating the water in the tank, characterized in that it comprises, when a water heating phase is actuated: activation of heating by the heating device, determination of a variation of the temperature in the tank over time and determination of at least one water filling state in the tank according to the variation over time.

The method according to the present invention also envisages, preferably, during the heating phase: periodic determination of a variation of the temperature in the tank over time during a predefined time interval, determination of an insufficient water filling state of the tank when a positive variation over time greater than a predefined value is detected and shutdown of the heating following the determination of the insufficient filling state.

The invention also relates to a system for heating water in a tank of a water heater, comprising a device for electrically heating the water and a device for managing heating configured to actuate the activation and deactivation of the heating device, characterized in that the device for managing heating comprises at least one temperature measurement sensor suitable for measuring a temperature in the tank and means arranged to carry out the method according to any one of the preceding claims.

The technical effect, induced by the method and the system for heating water of a water heater according to the invention, is that of preventing the risks of overheating in a water heater by detecting an insufficient water level in the tank of the water heater, liable to cause malfunctions of the water heater. The invention thus relates to a detection method that is relatively simple to implement and inexpensive suitable for avoiding, in the event of overheating of the heating device, water heater repair or replacement costs, which prove to be relatively high.

Advantageously, detection of a problem, particularly of insufficient water filling, takes place after a slight heating of the device such that no risk of material damage is involved. Particularly advantageously, the method according to the present invention, suitable for detecting a shortage of water in the tank, is performed at start-up but also during the heating time. The lack of water in the tank may arise at any time, it is thus advantageous for the protection to be continuously active.

BRIEF INTRODUCTION TO THE FIGURES

The aims, subject matter, and features and advantages of the invention will emerge more clearly from the detailed description of an embodiment thereof which is illustrated by the accompanying figures wherein.

Figure 1:
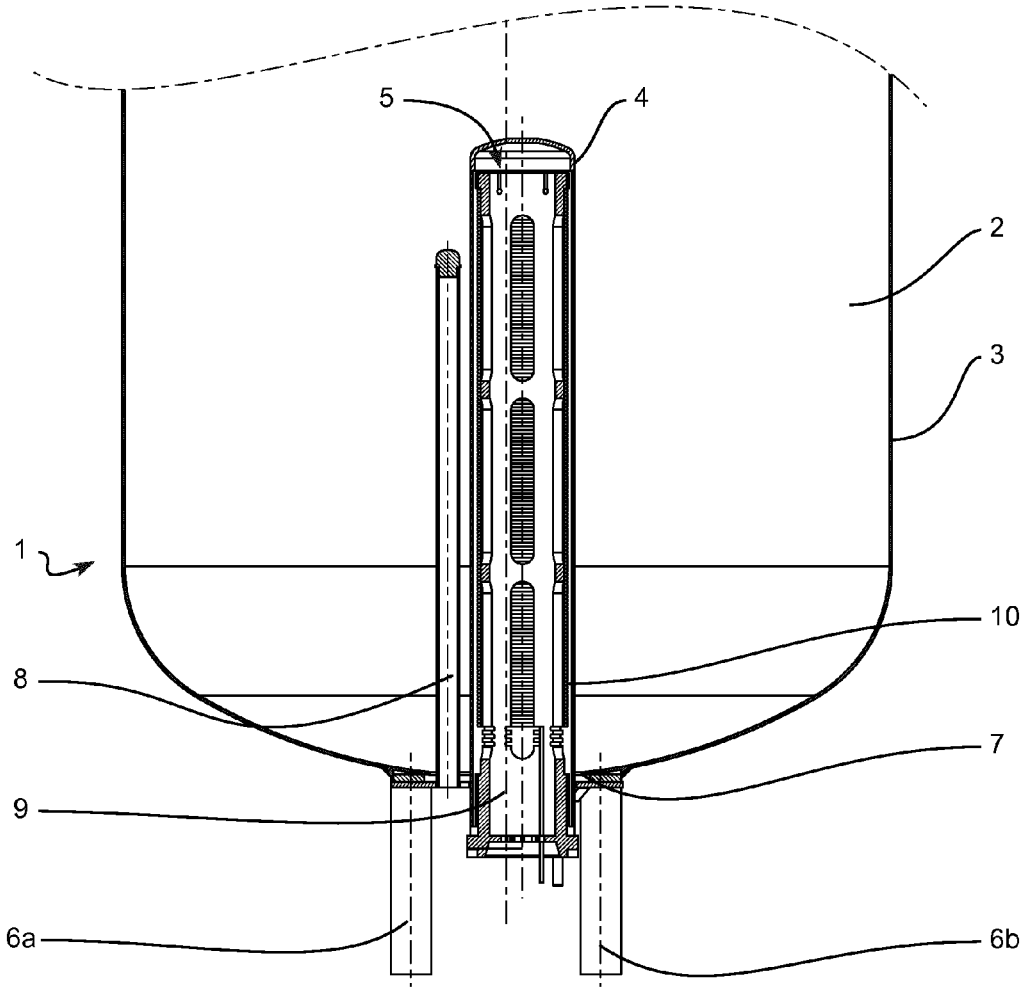
FIG. 1 illustrates a cross-section of a water heater. The water heater comprises a tank intended to hold a volume of water and a heating device.

The drawings are given by way of example and are not limiting in respect of the invention. They constitute schematic principle representations intended to facilitate the comprehension of the invention and are not necessarily to the scale of the practical applications.

DETAILED DESCRIPTION

Before beginning a detailed review of embodiments of the invention, optional features which may optionally be used in association or alternatively are listed hereinafter:

Advantageously, the determination of at least one filling state comprises the determination of an insufficient filling state when a positive variation over time greater than a predefined value is detected.

Preferentially, continuation or resumption of heating is inhibited following the determination of the insufficient filling state.

Advantageously, the inhibition is maintained until the determination of a sufficient filling state.

Particularly advantageously, during the inhibition, a second determination of a temperature variation over time is performed, a second determination of a water filling state of the tank is performed, comprising the determination of a sufficient filling state when a negative variation over time less than a predefined value is detected.

Preferably, the determination of at least one filling state comprises the determination of a sufficient filling state when a positive variation over time less than a predefined value is detected.

Preferentially, the heating phase is performed, actuated on determining the sufficient filling state.

Particularly advantageously, the determination of at least one filling state comprises the determination of a scaling state when a positive variation over time at least 10% less than the predefined value (D1) and preferably at least 25% less is detected.

Advantageously, during the heating phase, periodic determination of a variation of the temperature in the tank over time during a predefined time interval, determination of an insufficient water filling state of the tank on determining a positive variation over time greater than a predefined value, shutdown of the heating following the determination of the insufficient filling state are performed.

Preferentially, the determination of a variation over time is performed by calculating the ratio of the difference between a temperature measured on activating heating and a temperature after a predefined time, and the predefined time.

The predefined time is preferably between 2 and 4 minutes.

Preferentially, the heating is performed at a power less than 1500 kW. These values vary according to the characteristics of the tank, notably the volume thereof.

Advantageously, the heating is stopped before the determination of at least one filling state.

Particularly advantageously, a heating device including at least one inductor and at least one load is used, the inductor being configured to produce an induced current in the load. This technique can be transposed to other, particularly resistive, heating systems. The advantage of the induction system is, on one hand, the ease of control of the power, and, on the other, the presence of electronic temperature sensors associated with a high-performance processing system (microcontroller) for carrying out with precision heating and temperature measurement sequences during these heating phases.

Preferentially, the heating device includes at least one inductor and at least one load, the inductor being configured to produce an induced current in the load.

The water heater preferably includes a tank suitable for holding water and a system according to the invention.

Advantageously, the tank is delimited by a peripheral jacket and the wall of a sheath situated in the internal volume of the peripheral jacket, the heating device being at least partially immersed in the sheath.

Preferentially, the load is formed at least partially by the wall of the leak-tight sheath and the inductor is housed in the sheath.

FIGS. 1 to 4 describe an example of a water heater comprising a device for electrically heating water and a device for managing heating configured to actuate the activation, monitoring and deactivation of the heating device, for executing the method according to the invention.

FIG. 1 illustrates a cross-section of a water heater 1. The water heater 1 comprises a tank 2 intended to hold a volume of water and a heating device. The tank 2 has, for example, a capacity greater than 10 liters, preferably, greater than 20 liters. The tank 2 is delimited on one hand by a peripheral jacket 3 and, on the other, by the wall 4 of a leak-tight sheath 5 immersed in the internal volume of the peripheral jacket 3. The tank comprises an opening 7, preferably in the form of a trap door, for inserting the heating element, this heating element being suitable for being inserted into a sheath in turn suitable for being inserted via the opening 7. The tank 2 comprises at one of the longitudinal ends thereof two orifices: one inlet orifice 6*a* of water intended to be heated and one heated water outlet orifice 6*b*.

The heating device comprises at least one inductor 10 housed in the sheath 5 and at least one load formed by at least one portion of the wall 4 of the sheath 5. The inductor 10 is advantageously, indirectly, heat-generating. The induction heating principle has numerous advantages. Induction requires a magnetic field generating an induced current and, thus, heating in this load. The inductor 10 may advantageously be positioned on a supporting member 9. Particularly advantageously, the supporting member 9 simplifies the winding phase in that it serves both for the embodiment of the inductor 10 and also for holding same in the water heater 1. This makes it possible to avoid long and costly phases for solidifying the induction coil so as to ensure the mechanical cohesion thereof (i.e. for example thermo-adhesion). The supporting member 9 is fixedly mounted in the sheath 5. Preferably, the supporting member 9 is fixed relative to the sheath 5 by only one of the ends thereof situated on the side of an opening 7; said opening 7 being situated via the peripheral jacket 3 of the water heater 1, at one of the longitudinal ends of the water heater 1.

Preferentially, the tank 2 and/or the sheath 5 and/or the inductor 10 have cylindrical shapes. According to a further embodiment, the sheath 5 and the inductor 10 have rectangular parallelepipedic shapes. In the latter case, the tank 2 adopts, particularly advantageously, a rectangular parallelepipedic shape so as to offer space-saving in use.

The water heater also comprises a device for managing heating at least one secondary heat sheath 8 intended to monitor the temperature inside the tank 2. The secondary sheath 8 may be presented in the form of a tube. This secondary sheath 8 is preferentially a sheath of small diameter suitable for receiving a temperature sensor which is, for example, an NTC (Negative Temperature Coefficient) type probe, the NTC probe being a thermistor wherein the resistance decreases uniformly with the temperature. It is necessary to ensure that the thermal contact between the secondary sheath 8 and the temperature probe positioned therein is correct. The secondary sheath 8 extends along the longitudinal direction of the sheath 5. The secondary sheath 8 is situated in the vicinity of the outer wall 4 of the sheath 5 and, for example, at less than 2 centimeters.

Figure 2:
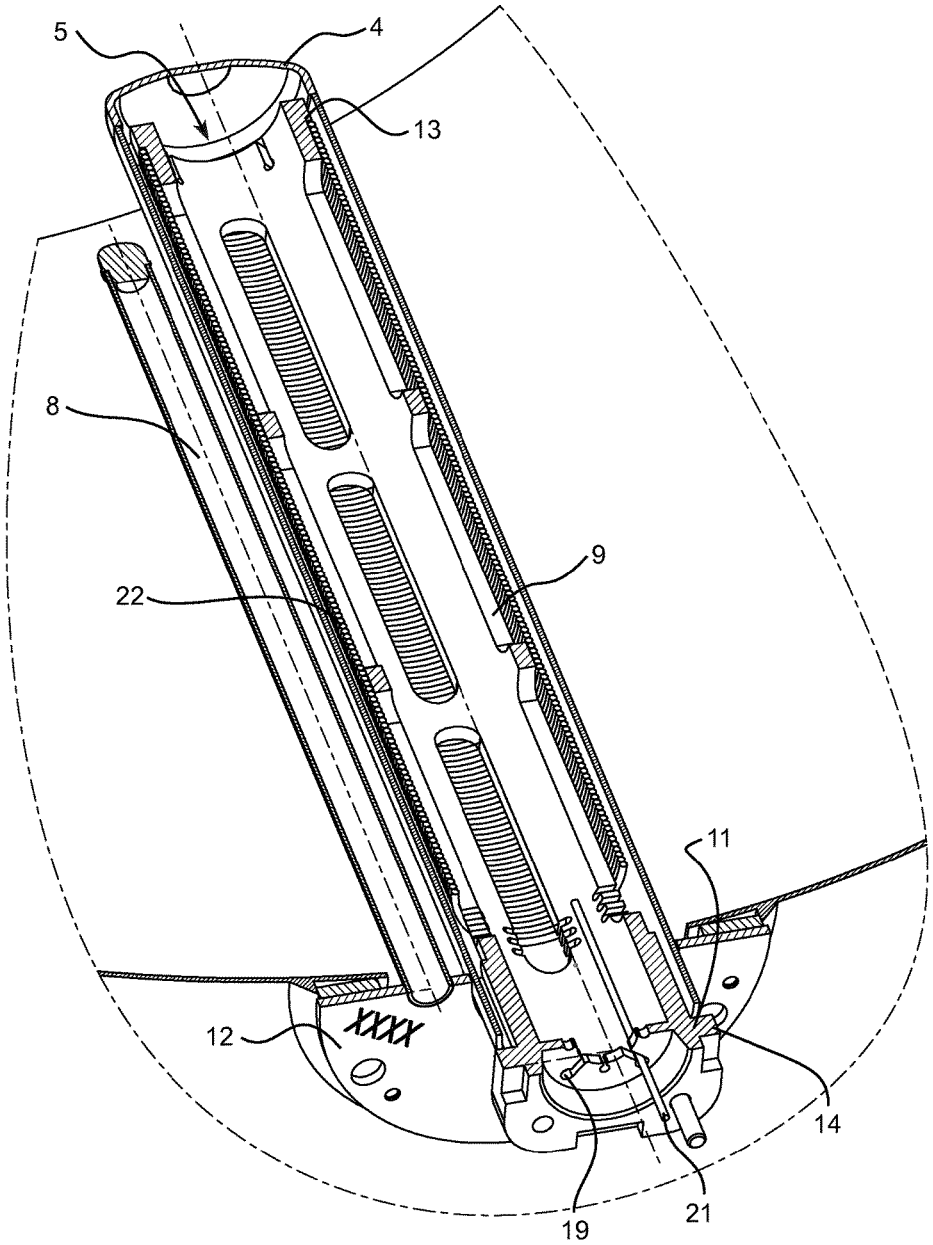
FIG. 2 illustrates a cross-section of the sheath wherein a heating element is situated.

FIG. 2 illustrates a cross-section of the sheath 5. The wall 4 of the sheath 5 is leak-tight so as to prevent water from entering the heating device. The wall 4 of the sheath 5 is advantageously formed from a steel sheet of thickness, for example, between 0.4 millimeters (mm) and 2.3 millimeters. Advantageously, the sheath 5 is enameled similar to the inside of the tank 2; the enamel adhering best on decarburized steel. Decarburized steel is very magnetic and thus proves to be a good load for an induction heating system. It should be noted that the heating power is dissipated in a thickness of approximately 0.4 mm (induction frequency of 20 kHz) in relation to the induction system and thus that it is necessary for the thickness of the sheath to be at least a thickness of 0.4 mm. The sheath 5 includes an opening for access to one of the ends thereof, the supporting member 9 being inserted into the sheath 5 via said end.

The secondary sheath 8 is preferentially attached by one of the longitudinal ends thereof on a first face of a plate 12 before being inserted into the tank 2. The secondary sheath 8 is a tube welded onto the same plate 12 as the sheath 5 and is enameled like said sheath 5. The plate 12 herein has the shape of a disk. The plate 12 is attached to the outer wall of the tank 2 via a seal. Advantageously, the sheath 5 comprises a base 11 attached to one of the longitudinal ends thereof. The base 11 is preferably in the shape of a disk or a square. Particularly advantageously, the heating device inside the sheath 5 can be removed from the water heater by merely removing the attachment means. Exceptionally, the heating device can be inspected, checked, or even replaced without opening thus without having to drain the tank 2.

The supporting member 9 serves as a supporting member for the coil 22. In order to "coil", the coil 22 wire 21 is inserted inside the supporting member 9 and crimped at the end of the base 11. The wire 21 is then stretched and passed through a slot of the bearing surface 13 situated at one of the ends of the supporting member 9. The supporting member 9 can then be attached on the winder (similar to a turning machine) and the coil 22 wire 21 which is inserted via the slot of the bearing surface 13 of the supporting member 9 is then immediately located in the correct position to start winding. At the end of winding, the wire is cut and inserted through securing slots 19 or notches until the bearing surface 14 situated at the other end of the supporting member 9 is reached. Advantageously, the supporting member 9 comprises a plurality of slots 19 as different inductor versions according to the power requirement are envisaged. The notches or slots 19 serve to lock the coil 22 wire 21 which is then reinserted in the center of the supporting member 9 to join the outgoing wire 21, but diametrically opposite. The two wires 21 are connected to the respective connectors thereof rigidly connected to the base 11.

Figure 3:
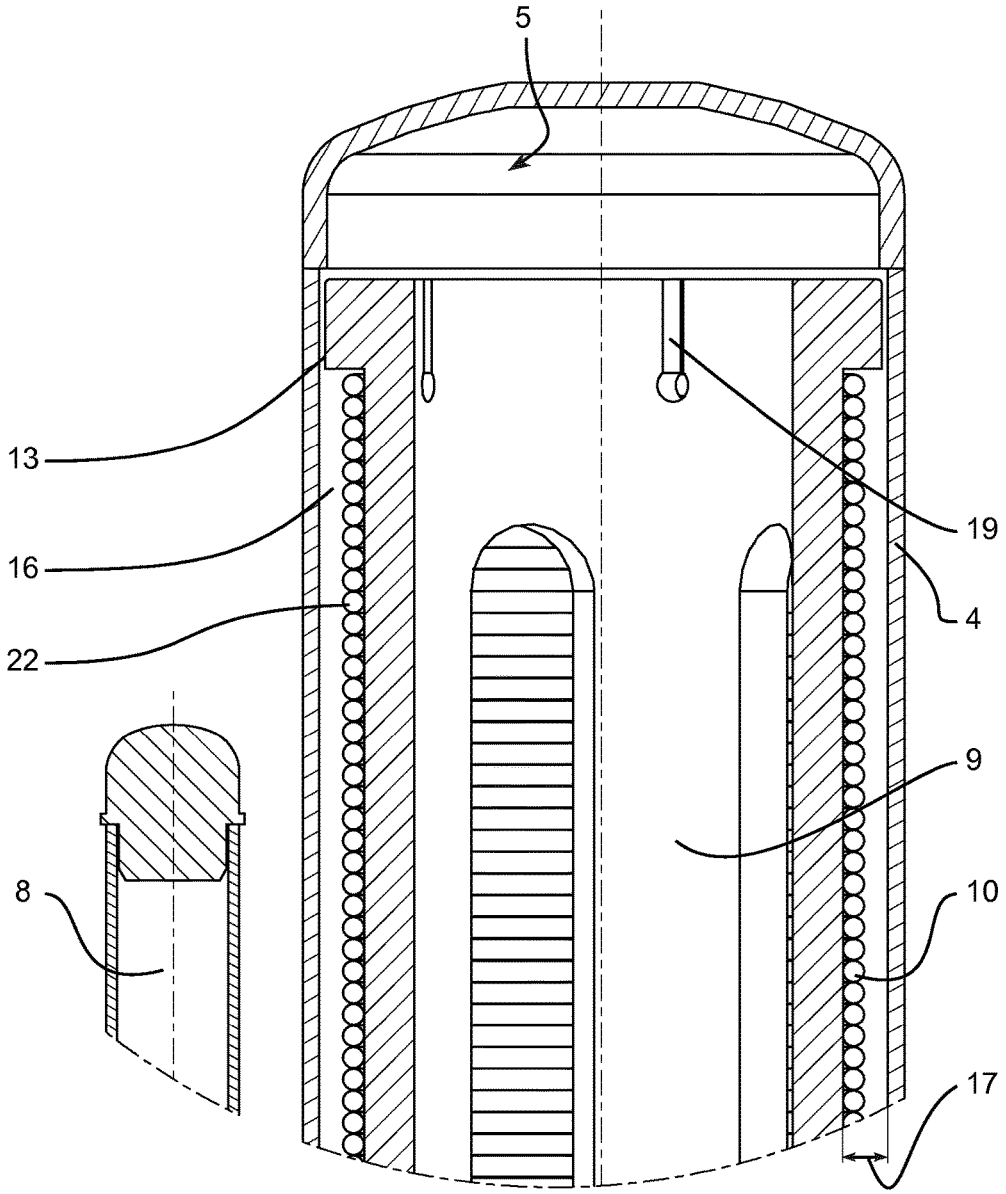
FIG. 3 illustrates a cross-section of the inside of the sheath.

FIG. 3 illustrates a cross-section of the inside of the sheath 5 and the secondary sheath 8. The inductor 10 includes a coil 22 formed on the supporting member 9. The supporting member 9 includes a lateral outer surface provided with a coil portion 22 and a fixing portion 13. The coil portion 22 is set back relative to the fixing portion 13. The fixing portion comprises a bearing surface 13 on the internal wall of the sheath 5. The bearing surface 13 includes two portions situated on either side of the coil portion 22 along a longitudinal direction of the sheath 5. The offset 17 of the coil portion 22 relative to the fixing portion 13 is greater than the thickness of the coil 22. The space 16 separating the coil 22 and the internal face of the wall 4 of the sheath 5 is, preferably, less than 5 millimeters and, advantageously, less than 1 millimeter. Surprisingly, it is advantageous for the coil 22 of the inductor 10 to be positioned in the vicinity of the sheath 5. This favors a concentration of the heating on only one portion of the thickness of the sheath 5. It should be noted that, surprisingly, a person skilled in the art tends to separate induction type coils from the heated elements. Indeed, as their name suggests, the heated elements heat and tend to induce the heating of the induction systems if they are positioned too close. However, the induction coils are generally insulated with organic varnishes, the most effective whereof cannot withstand temperatures greater than 220° C. In the present invention, heating is advantageously applied to the internal wall 4 (of a thickness for example of 0.4 mm) of the sleeve 5 which is heated. However, the sheath 5 is immersed in the water with which it exchanges the heat thereof. During the heating phase, the temperature of the sheath 5 is thus always greater than the temperature of the water for heat exchange to take place, but the difference in temperature remains small, for example 30° C. for an injected power of 1800 Watts (W). For this reason, if the maximum temperature of the water to be heated is 65° C., the sheath 5 attains a maximum of 95° C. and the sheath 5 can then be considered to be a cold zone for the induction coil 22. It is then advantageous to move the induction coil 22 closer to the sheath 5 so as to cool same. This moving closer together is also advantageous for the design thereof as the coupling with the load is then increased and therefore the induction system 10 needs less ampere-turns in order to function correctly with the associated inverter thereof, which increases the yield of the whole and thus lowers the cost. Finally, it should be noted that it may be necessary to insert an additional electrical insulator around the coil 22 in the event of the distance, between the coil 22 and earthed sheath 5, becoming small.

The bearing surface 13 and the internal face of the sheath 5 are arranged in a slide fit. Particularly advantageously, during the insertion of the supporting member 9 into the sheath 5 and in use, the bearing surface 13 prevents the coil from coming into contact with the internal face of the wall 4 of the sheath 5. Advantageously, the diameter of the bearing surface 13, 14, greater than the diameter of the coil portion 22, makes it possible, on one hand, to protect the coil 22 and, on the other, control the insertion play of the supporting member 9 comprising the coil 22 in the sheath 5.

Figure 4:
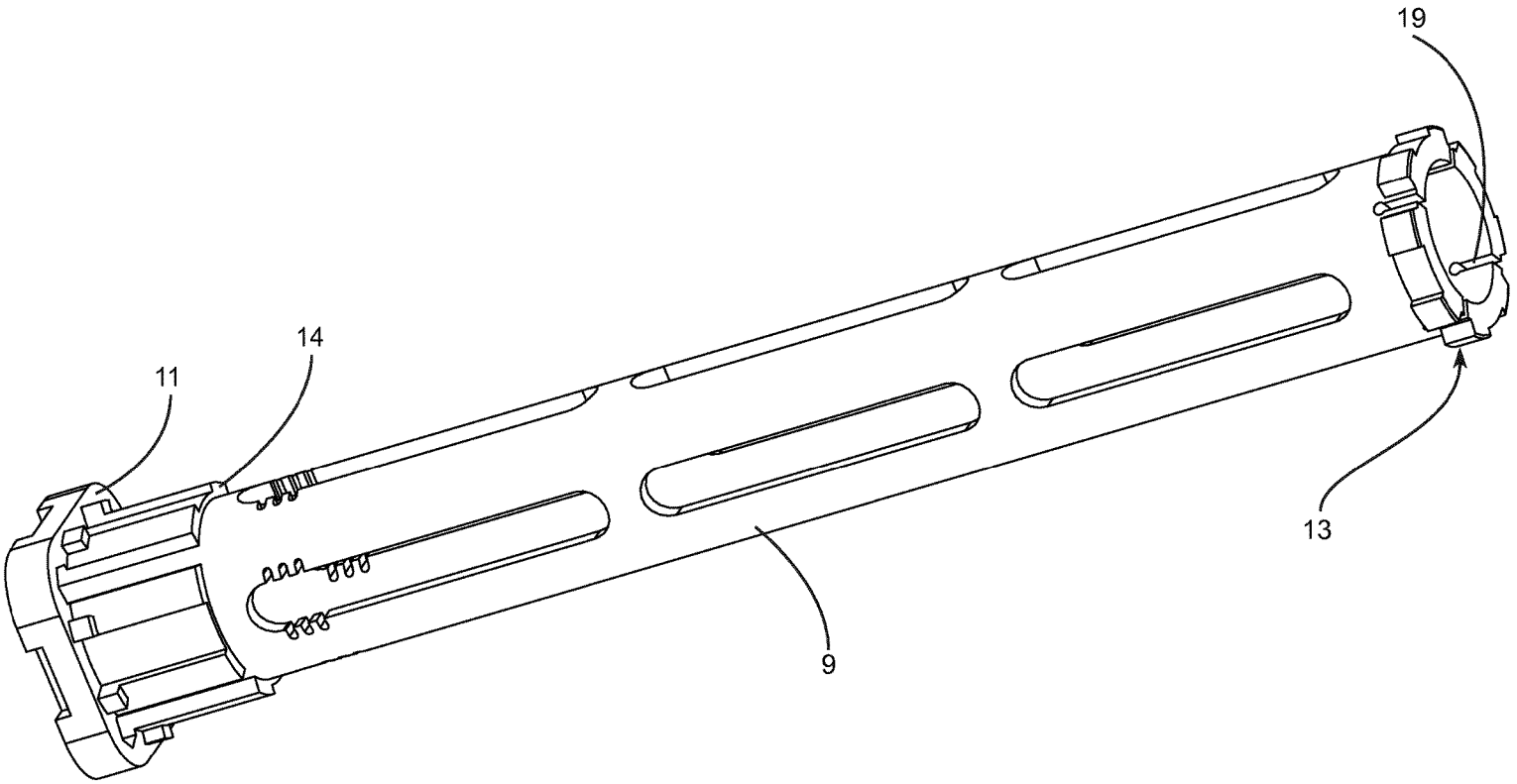
FIG. 4 is a view of a supporting member intended to be housed inside the sheath.

FIG. 4 illustrates a view of the supporting member 9. The supporting member 9 is preferentially presented in the form of a hollow tube. Particularly advantageously, the supporting member 9 is configured so as to engage with the shape of the internal wall 4 of the sheath 5. A first longitudinal end of the supporting member 9 comprises a first fixing portion including a base 11, a bearing surface 13, 14 and at least one slot 19 for holding the coil 22 wire 21. A second longitudinal end of the supporting member 9, opposite the first, comprises a bearing surface 13, 14 and at least one slot 19, 20 for holding the coil 22 wire 21. The bearing surface 13, 14 includes, particularly advantageously, a plurality of apices of slots formed on an annular portion of the fixing portion. Preferentially, the slots help balance the supporting member 9 inside the sheath 5. They also limit hyperstatic phenomena during insertion. The slots advantageously make it possible to simplify the coil 22. According to one embodiment where the sheath 5 has a rectangular parallelepipedic shape, a Pan Cake type induction coil 22 will preferably be used, without having to use a supporting member 9.

Advantageously, the wall of the supporting member 9 is open-worked so as to promote heat transfer within the sheath 5, minimize the weight of the supporting member 9 and thus the cost thereof. Preferably, the supporting member 9 is formed from materials resistant to high temperatures such as plastics (for example, BMC "Bulk Molding Compound" comprising Polyester resin or Vinylester) reinforced with glass fibers. In position, the supporting member 9 extends along the longitudinal direction of the sheath 5. The supporting member 9 is advantageously hollow and the center thereof may allow the passage of the coil 22 wire 21.

Figure 5:
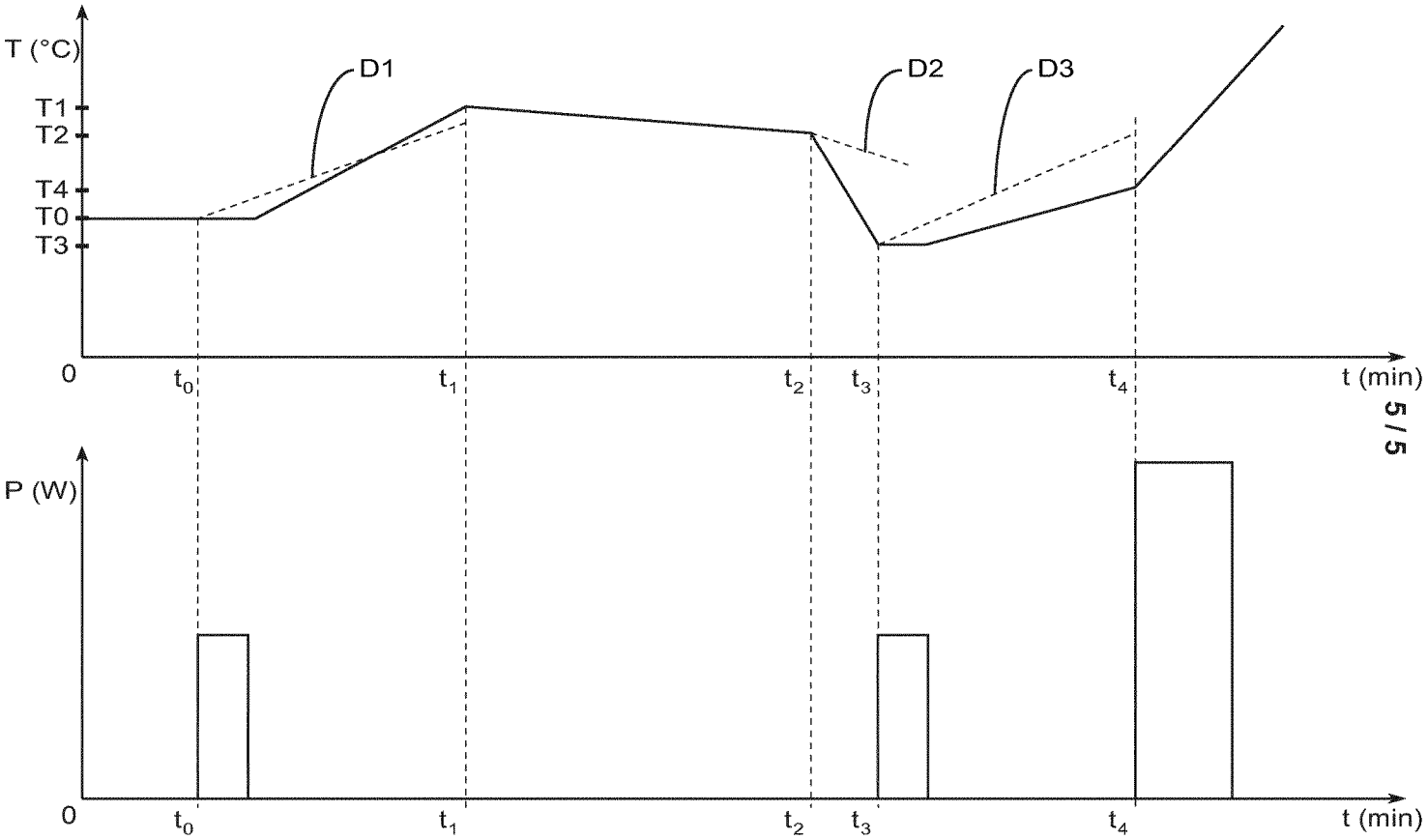
FIG. 5 illustrates a schematic representation of the different steps of the method according to the invention relative to time and temperature variables.

FIG. 5 illustrates a schematic representation of the various steps of the method according to the invention relative to variables in respect of time t and temperature T. The various phases presented are merely examples of possible scenarios. Furthermore, the temperature variations are illustrated as being linear, but merely to simplify the representation of the principle of the invention, these variations optionally having further curve shapes. The device for managing heating includes at least one secondary sheath 8 for measuring temperature suitable for measuring a temperature in the tank 2 and means arranged to execute the method. The secondary sheath 8 is advantageously equipped with a temperature probe. This probe is preferably inserted to a stop into the secondary sheath 8. The data measured by the sensor are, advantageously, transmitted to means arranged to execute the method according to the invention. Preferentially, these means include a microprocessor or a microcontroller and are suitable for retrieving the data, analyzing same and then transmitting control information, for example, to stop or continue heating to the heating device of the water heater. These means may comprise any electronic components such as automatic control systems, memories, data reception and acquisition interfaces, for example of temperature, and control interfaces, and instructions executable by at least one processor to implement the method presented herein.

When a water heating phase is actuated, a first step at a time $t_0$, consists of activation of heating by the heating device, after having previously detected the initial temperature $T_0$ in the tank 2. Preferably, the heating device comprises an inductor 10.

The heating activation starts, preferably, with a phase wherein the energy is limited so not to damage the heating element and the environment thereof should the tank 2 have a shortage of water, or be very significantly scaled. Particularly advantageously, if the tank 2 is empty, the activation of heating does not give rise to destructive overheating, either of the heating system, of the sheath 5, or the tank 2. The duration of the test phase is, for example, 1 minute. Following this phase, the device is shut down automatically for the time required to study the behavior of the tank 2 in respect of temperature. For a duration of 1 minute, the heating is preferentially carried out at a power less than 1500 kW. The heating device has thus generated heat in the sheath 5. As such, the behavior will be different according to whether the sheath 5 is immersed in water (tank 2 full) or in air (tank 2 empty). The temperature sensor being situated in the secondary sheath 8 in the vicinity of the sheath 5, the temperature to be detected by the sensor will depend on the interface between the secondary sheath 8 and the sheath 5, and will thus determine whether water is present in the tank 2 or not.

After a predefined time $t_1$, for example of 3 minutes, a variation of temperature over time in the tank 2 is determined. The term variation over time denotes the derivative over time, i.e. the ratio of the difference between a temperature measured on activating heating and a temperature after a predefined time, and the predefined time. The predefined time is preferentially between 2 and 4 minutes. Nonetheless, shorter times are possible (this is dependent on the injected energy, the mass and geometry of the different elements), up to the determination of an instant variation, at the temperature data acquisition frequency.

Hence, following this determination of temperature variation over time in the tank 2, a determination at the time $t_1$, of a water filling state of the tank 2 as a function of the variation over time; the aim being to determine on the basis of the variation over time, the water filling state of the tank 2.

The predefined value $D_1$ represents a mean temperature variation value between the time $t_0$ and the time $t_1$, following a given phase having generated a heat supply. The value $D_1$ advantageously represents a ratio of a difference in temperature measured between two times, and more specifically a thermal limit corresponding to the transition from water to air. If there is no water in the water heater 1, the primary sheath 5 heats rapidly and transmits the heat thereof to the very close secondary sheath 8, for example situated 6 mm from the sheath 5. In the scenario whereby the primary sheath 5 is immersed in the water, the energy supplied is not sufficient to increase the temperature of the water significantly and thus the temperature progression is slight.

If the variation over time measured in the tank 2 and detected at the time $t_1$ is positive less than the predefined value $D_1$, then this means that the sheath 5 is immersed, not liable to damage the water heater 1. That being said, if water is present, in general, the water heater 1 is full. The water shortage scenario is observed primarily during the installation or restarting of the water heater 1 in second homes, for example. It should be noted that it is necessary to bleed the installation in order to drain a water heater 1. In this case, the heating device may, advantageously, continue heating the water in complete safety, without any risk of overheating and/or damaging the water heater 1. The possible damage could apply to the heating element but also to the enamel of the sheath 5 and the thermal insulation of the tank 2. In the scenario whereby the heating element is changed, the water heater would then operate with reduced performances. Oxidation, removal of the enamel and degradation of the thermal insulation of the tank 2 could be observed.

If the variation over time measured in the tank 2 and detected at the time $t_1$ is positive greater than the predefined value $D_1$, corresponding to an excessive temperature rise, then this means that the tank 2 contains an insufficient water level, liable to damage the water heater 1 significantly. Overheating of the heating device in the tank 2 may give rise to serious damage such as the malfunction, or the destruction of the water heater 1, liable to incur relatively high replacement or repair costs.

As such, if the variation over time is positive greater than $D_1$ then, at the time $t_1$, an inhibition of continuation of heating is performed. The time interval between $t_1$ and $t_2$ corresponds to a waiting time which is not significant in the light of the time required for heating the water of the tank 2. After an increase in the temperature associated with the given phase at the time $t_0$, a peak temperature $T_1$ is observed at the time $t_1$ followed progressively by a decrease in the temperature corresponding to normal cooling of the sheath 5 following the shutdown of the heating device.

After a time $t_2$, FIG. 5 shows the scenario whereby the tank 2 is filled with water. The entry of water, generally cold, into the tank 2, will give rise to a significant thermal variation on the sheath 5 and on the secondary sheath 8 comprising a temperature probe. During the inhibition, i.e. in the time interval $t_1$ and $t_2$, a second determination of a variation of temperature over time is performed, followed by a second determination of a water filling state comprising the determination of a sufficient filling state on determining a negative variation over time less than a predefined value $D_2$. This value reveals a limit variation reflecting an intake of cold water.

After filling with water, the variation over time, i.e. the derivative over time, is detected as being negative, corresponding to a decrease in the temperature inside the tank 2 in the time interval $t_2$ and $t_3$.

After a time $t_3$, when the predefined temperature $T_3$ has been reached, corresponding to a sufficient water filling state of the tank 2, a heating phase is performed. During the heating phase, a periodic determination of a variation of temperature over time in the tank 2 during a predefined time interval, for example between $t_3$ and $t_4$, is carried out. If the variation over time measured at this time is positive less than a predefined value $D_3$ then the filling state of the tank 2 is deemed to be sufficient, the method for heating water in the tank 2 is continued. This phase is similar to the heating activation phase carried out at the start of the method, from the time $t_0$.

As of the time $t_4$, when no anomaly is detected in the heating device, then the power may advantageously be increased to as to heat the water of the tank 2 more rapidly. It is thus possible, for example, to implement a heating power in test mode at a low level and one or a plurality of values, which are higher, in effective heating mode, if the tests are conclusive.

The steps for monitoring the variation of temperature over time are repeated several times, or even periodically and continuously, during the heating phase so as to check the sufficiency of the level of the water present in the tank 2. If during these checks, a positive variation over time greater than a predefined value is detected, this means that the water filling state of the tank 2 is insufficient, the heating device is then shut down.

The method according to the invention thus makes it possible to detect and prevent any overheating problems, very frequently caused by a water filling shortage of the heating body 2. This shortage notably includes an empty tank 2 but also a partially filled tank 2, below a predefined filling level.

According to one complementary or alternative embodiment to the detection of a shortage of water in the tank 2, the method according to the invention may advantageously be suitable for detecting scaling of the heating element.

Following the preliminary heating test phase, the heating device is shut down automatically for the time required to study the temperature-related behavior of the tank 2, the heating device having generated heat in the sheath 5. Advantageously, the heating time may vary and have a different duration to that envisaged during the heating test phase. As such, the temperature-related behavior will be different according to whether the sheath 5 is immersed in water (tank 2 full), in air (tank 2 empty) or the sheath 5 is scaled.

The temperature sensor advantageously situated in the secondary sheath 8 will determine whether water is present in the tank 2 or whether there is severe scaling of the heating element. In the scenario whereby the heating element is subject to significant scaling, the primary sheath 5 will not be heated rapidly. The energy supplied is not sufficient to significantly increase the temperature of the water and, for this reason, the temperature progression is very slight.

If the variation over time measured in the tank 2 and detected at the time t1 or at another time is positive and very considerably less than the predefined value D1, then this means that the sheath 5 is immersed and very possibly scaled.

According to one embodiment, when a very slight temperature variation is detected, an alert signal may be activated in order to inform the user of any scaling of the heating element. In this case, the user would have the choice of descaling the device in order to avoid incurring significant replacement or repair costs. Advantageously, one alternative would be to reduce the heating power to protect the heating element and the environment thereof. Particularly advantageously, these various actions may be controlled by a microprocessor.

The use of the method according to the invention for induction heating systems, particularly those housed in a sheath 5, is advantageous as such heating may be brief and have readily adapted powers. As such, the test phases of the invention may be carried out without significant heating energy production and thus without a risk of material damage and at a low electricity consumption.

The present invention is not limited to the embodiments described above but extends to any embodiment covered by the claims.

REFERENCES

1. Water heater
2. Tank or heating body
3. Peripheral jacket
4. Wall of sheath
5. Sheath
6*a*, 6*b*. Orifice
7. Opening
8. Secondary sheath
9. Supporting member
10. Inductor
11. Base
12. Plate
13, 14. Bearing surface
16. Space
17. Offset
19. Slot
21. Wire
22. Coil
$D_1$, $D_2$, $D_3$. Predefined values
$t_0$, $t_1$, $t_2$, $t_3$, $t_4$. Time correspond to temperature measurements
$T_0$, $T_1$, $T_2$, $T_3$, $T_4$. Temperatures measured at different times

The invention claimed is:

1. A method for managing heating of water in a tank of a water heater which comprises a heating device for electrically heating the water in the tank, wherein said method, when a water heating phase is actuated, comprises the steps of:

activating heating by the heating device, the heating being performed at a first level of electrical power;

determining a variation of a temperature of the water in the tank over time during a predefined time interval by determining a first temperature of the water in the tank, waiting a predefined time and determining a second temperature of the water in the tank, the variation of the temperature of the water in the tank being a function of the first temperature of the water in the tank and the second temperature of the water in the tank;

determining at least one water filling state in the tank according to the variation of the temperature of the water in the tank over time, comprising:

determining an insufficient water filling state of the tank when a positive variation over time greater than a predefined value D3 is detected, or determining a sufficient water filling state when a positive variation over time less than a predefined value D1 is detected;

if the positive variation over time greater than the predefined value D3 is detected, shutting down the heating following a determination of the insufficient water filling state; and if the positive variation over time less than the predefined value D1 is detected, performing further heating by the heating device, the further heating being performed at a second level of electrical power that is greater than the first level of electrical power.

2. The method according to claim 1, wherein the determining the at least one water filling state further comprises determining an insufficient water filling state when a positive variation over time greater than the predefined value D1 is detected.

3. The method according to claim 2, further comprising inhibiting a continuation of heating following a determination being made in the determining the at least one water filling state of the insufficient water filling state when the positive variation over time greater than the predefined value D1.

4. The method according to claim 3, wherein the inhibiting is maintained until a determination is made in the determining the at least one water filling state of the sufficient water filling state.

5. The method according to claim 4, wherein, during the inhibiting, a second determination of a temperature variation of the water in the tank over time is performed, and a second determination of a water filling state of the tank is performed, the second determination of the water filling state of the tank comprising determining a sufficient water filling state when a negative variation over time less than a predefined value D2 is detected.

6. The method according to claim 1, further comprising determining a scaling state exists when a positive variation over time below 10% less than the predefined value D1 is detected.

7. The method according to claim 1, wherein the determining of the variation of the temperature of the water in the tank over time is performed by calculating a ratio of a difference between a temperature measured on activating heating and a temperature after the predefined time, and the predefined time.

8. The method according to claim 7, wherein the predefined time is between 2 and 4 minutes.

9. The method according to claim 1, wherein the first level of electrical power is a power less than 1500 kW.

10. The method according to claim 1, wherein the heating is stopped before a determination in the determining the at least one water filling state is made.

11. The method according to claim 1, wherein the heating device includes at least one inductor and at least one load, the at least one inductor being configured to produce an induced current in the at least one load.

12. A system for heating the water in the tank of the water heater according to claim 1, said system comprising the heating device for electrically heating the water and a device for managing heating, the device for managing heating configured to actuate activation and deactivation of the heating device, wherein the device for managing heating comprises at least one temperature measurement sensor suitable for measuring a temperature of the water in the tank.

13. The system according to claim 12, wherein the heating device includes at least one inductor and at least one load, the at least one inductor being configured to produce an induced current in the at least one load.

14. The water heater including the system according to claim 12 and the tank suitable for holding water.

15. The water heater according to claim 14, wherein the tank is delimited by a peripheral jacket and by a wall of a leak-tight sheath situated in an internal volume of the peripheral jacket, the heating device being at least partially embedded in the leak-tight sheath.

16. The water heater according to claim 15, wherein the heating device of the system includes at least one inductor and at least one load, the at least one inductor being configured to produce an induced current in the at least one load, the at least one load is formed at least partially by the wall of the leak-tight sheath, and wherein the at least one inductor is housed in the leak-tight sheath.

17. The method according to claim 2, further comprising inhibiting a resumption of heating following a determination made in the determining of the insufficient water filling state when the positive variation over time greater than the predefined value D1 is detected.

18. The method according to claim 1, further comprising determining a scaling state exists when a positive variation over time below 25% less than the predefined value D1 is detected.

19. The water heater according to claim 15, wherein the tank is further delimited by a wall of a secondary leak-tight sheath situated in the internal volume of the peripheral jacket, the at least one temperature measurement sensor being at least partially embedded in the secondary leak-tight sheath.

20. The water heater according to claim 19, wherein the tank extends along a first longitudinal direction, the leak-tight sheath extends along a second longitudinal direction being parallel to the first longitudinal direction, and the secondary leak-tight sheath extends along a third longitudinal direction being parallel to the second longitudinal direction.

21. A water heater including a tank suitable for holding water and a system for heating water of the tank, said system comprising a heating device for electrically heating the water and a managing device for managing heating configured to actuate activation and deactivation of the heating device, wherein:

the tank is delimited by a peripheral jacket extending along a first longitudinal direction, by a wall of a leak-tight sheath situated in an internal volume of the peripheral jacket and extended along a second longitudinal direction and by a wall of a secondary leak-tight sheath situated in the internal volume of the peripheral jacket and extended along a third longitudinal direction, the second longitudinal direction being parallel to the first longitudinal direction and the third longitudinal direction being parallel to the second longitudinal direction;

the heating device is at least partially embedded in the leak-tight sheath and includes at least one inductor and at least one load, the at least one inductor being configured to produce an induced current in the at least one load, the at least one load being formed at least partially by the wall of the leak-tight sheath; and the managing device comprises at least one temperature measurement sensor suitable for measuring a temperature in the tank and is at least partially embedded in the secondary leak-tight sheath.

* * * * *